US006932487B2

(12) United States Patent
Aknine

(10) Patent No.: US 6,932,487 B2
(45) Date of Patent: Aug. 23, 2005

(54) LIGHTING DEVICE DESIGNED TO FIT ON A MOUNTING, PARTICULARLY TEXTILE

(76) Inventor: Jacques Aknine, 25 Rue Lortet, Lyon (FR), F-69007

( * ) Notice: Subject to any disclaimer, the term of this patent is extended or adjusted under 35 U.S.C. 154(b) by 0 days.

(21) Appl. No.: 09/783,170

(22) Filed: Feb. 15, 2001

(65) Prior Publication Data

US 2001/0024365 A1 Sep. 27, 2001

(51) Int. Cl.[7] ..... F21L 15/14; F21L 7/00

(52) U.S. Cl. ..... 362/106; 362/105; 362/191; 362/365

(58) Field of Search ..... 362/106, 105, 362/103, 108, 190, 191, 226, 365, 368, 374

(56) References Cited

U.S. PATENT DOCUMENTS 1,914,429 A * 6/1933 Houlihan et al.
3,032,647 A * 5/1962 Wansky et al. ..... 362/106
5,363,291 A * 11/1994 Steiner ..... 362/191
5,738,431 A * 4/1998 Lary ..... 362/106
5,741,060 A * 4/1998 Johnson ..... 362/106
5,743,621 A * 4/1998 Mantha et al. ..... 362/105
6,183,116 B1 * 2/2001 Harter et al.

* cited by examiner

*Primary Examiner*—Sandra O'Shea
*Assistant Examiner*—Bao Truong
(74) *Attorney, Agent, or Firm*—Robert Ryan Morishita; Anderson & Morishita, LLC

(57) ABSTRACT

Lighting device for equipping a mounting, particularly textile, comprising a case provided with a rechargeable or dry battery or batteries that power a lamp bulb, characterized in that the case has a housing on its front surface that contains the lamp, the front surface of said lamp being positioned against the inner surface of the textile mounting which has an opening in this region that is more or less the same size as the lamp, the case being held in position by means of the textile mounting being gripped by a movable outer ring that operates in conjunction with the case.

19 Claims, 3 Drawing Sheets

2
29
25
24
26
27
28
35
36
30
9-10
8
20
37
33
31
32
26
2
1

LIGHTING DEVICE DESIGNED TO FIT ON A MOUNTING, PARTICULARLY TEXTILE

FIELD OF THE INVENTION

The present invention relates to a lighting device designed to fit on a mounting, particularly textile.

BACKGROUND OF THE INVENTION

In the description that follows the lighting device will be described with particular reference to head wear such as hats, berets, sailor-hats, uniform head wear, caps etc. It will, however be clear that the lighting device disclosed may be fitted to any textile mounting, particularly clothing, as well as rigid mountings such as plastic caps.

Several solutions have been proposed to fit lighting devices to caps, particularly baseball caps.

For example, U.S. Pat. No. 5,738,431 discloses a lighting case fitted to a cap and held in position by the type of hook and loop fastening system sold under the mark Velcro®. The size of the case means that the case can only be positioned outside the cap; moreover it is impossible to adjust the direction of the beam.

U.S. Pat. No. 5,741,060 discloses a smaller system consisting of a mounting fitted with two light bulbs and a switch mounted under the visor of the cap body. Like the invention of the previous patent, no adjustment of the direction of the beam is possible. Moreover, the positioning of the lighting device is limited in that it can only be fastened to a horizontal mounting.

U.S. Pat. No. 5,541,816 discloses a cap in which the visor is fitted with a lighting system with an adjustable beam. More exactly, the device disclosed consists of a case containing a battery that powers an adjustable lamp fastened to the underside of the cap visor. Although this system allows the direction of the beam to be adjusted, it is clumsy and unattractive in appearance. Moreover the weight of the batteries tends to cause sagging of the visor so that the lamp may obstruct the user's field of vision.

SUMMARY OF THE INVENTION

The aim of the invention is, thereof, to provide a lighting device that can be fitted to a mounting, particularly textile, and specifically a cap, that is attractive, of a limited size and weight and whose beam is adjustable, at least vertically.

The invention achieves this by proposing a lighting device designed to be fitted to a mounting, particularly textile, comprising a case that contains a rechargeable or dry battery or batteries powering the bulb of the lamp.

The device is characterized in that the front surface of the case is provided with a housing to receive the lamp, the front surface of said case being designed to be positioned against the inner surface of the textile mounting which is provided with an opening in this region that is more or less the size of the lamp, the case being held in position by means of the textile mounting being gripped by a movable outer ring that operates in conjunction with the case.

In other words, the body of the case is concealed behind the textile mounting, said textile mounting being cut so that only the lamp and its housing appear. The assembly is held in place by the textile mounting being gripped between the case and the body of a ring fitted with means to operate in conjunction with specially provided arrangements in the mounting. Thus only the lamp is seen through the textile mounting, giving the entire system a particularly attractive appearance.

In order to improve the appearance and to reduce the size of the device further, the lamp does not protrude beyond the outside of its housing. In an advantageous embodiment the front surface of the lamp is aligned with that of the case.

Moreover, in order that the beam may be adjusted vertically, the lamp includes a reflector that forms an integral part of a horizontal pivoting pin, the free ends of which operate in conjunction with matching recesses cut into the sides of the housing.

Clearly the pivoting pin may be positioned differently depending on the required adjustment of the lamp. For example, the pin may be positioned vertically to give lateral adjustment of the lamp beam.

In a preferred embodiment, and particularly where the length of the lamp is greater than the thickness of the case, the housing is constructed as a window, particularly a cylindrical window fitted into the thickness of the case, said window extending from the inner wall of the case into a projecting cavity.

Advantageously, the window and the cavity have a circular cross section and the diameter of the window is greater than that of the cavity. Furthermore, the window and the cavity are connected by a partition.

In order to limit the amplitude of the vertical pivoting of the lamp the base of the housing and, in this case the cavity, present at least one stop intended to come into contact with the rear end of the lamp to limit the travel of the lamp.

According to another aspect of the device the base of the housing is also provided with two metal blades to ensure electrical contact with the positive and negative terminals of the lamp bulb.

Advantageously, the blades are curved towards the lamp to ensure they slide into contact with the bulb when said lamp is pivoted around its horizontal axis.

In a preferred embodiment of the intention both the metal blades have a hollow to stop the electrical contact when the optical axis of the lamp is perpendicular to the plane of the case.

In practical terms the user presses the front surface of the lamp to tilt said lamp forwards or backwards and by so doing brings the lamp into contact with the conductor blades thus providing it with a power supply. To switch off the light the lamp is returned to the horizontal position in order to cut the power supply.

Advantageously, the lamp can be set to three directions in the vertical plane that match three pitches provided on the metal blades.

As described above the case is fastened to the textile mounting by said mounting being gripped between the front surface of the case and a ring designed to operate in conjunction with appropriate means provided in the housing.

Advantageously, the ring is provided with two arms that operate elastically in conjunction with the housing at the matching aperture in the partition that connects the window and the cavity together.

Clearly the ring may be joined to the case using any other known means of the screwing or bonding type.

To prevent the case from moving once it has been fastened, the rear surface of the ring and the front surface of the case have a plurality of spikes near the housing that are intended to operate in conjunction with the textile mounting.

According to another aspect of the invention the case comprises at least one compartment containing a battery intended to provide the blades fitted in the base of the housing with a power supply.

The invention also relates to headwear to which the lighting device of the invention is fitted.

In an advantageous embodiment the headwear is in the form of a cap the front of which has been cut away to enable the lighting device described above to be fitted.

The cap is also provided with a lining to protect the user's skin from the case and particularly from the electric terminals.

In an advantageous embodiment the lining contains foam for improved comfort.

To prevent the lighting device from applying any pressure to the user's forehead the inner surface of front of the cap is provided with a padded seam the thickness of which is greater than that of the case, said padded seam being located under the case.

BRIEF DESCRIPTION OF THE DRAWINGS

The invention and its aims will be better understood from the following embodiment which refers to the attached figures where.

DESCRIPTION

Figure 1:
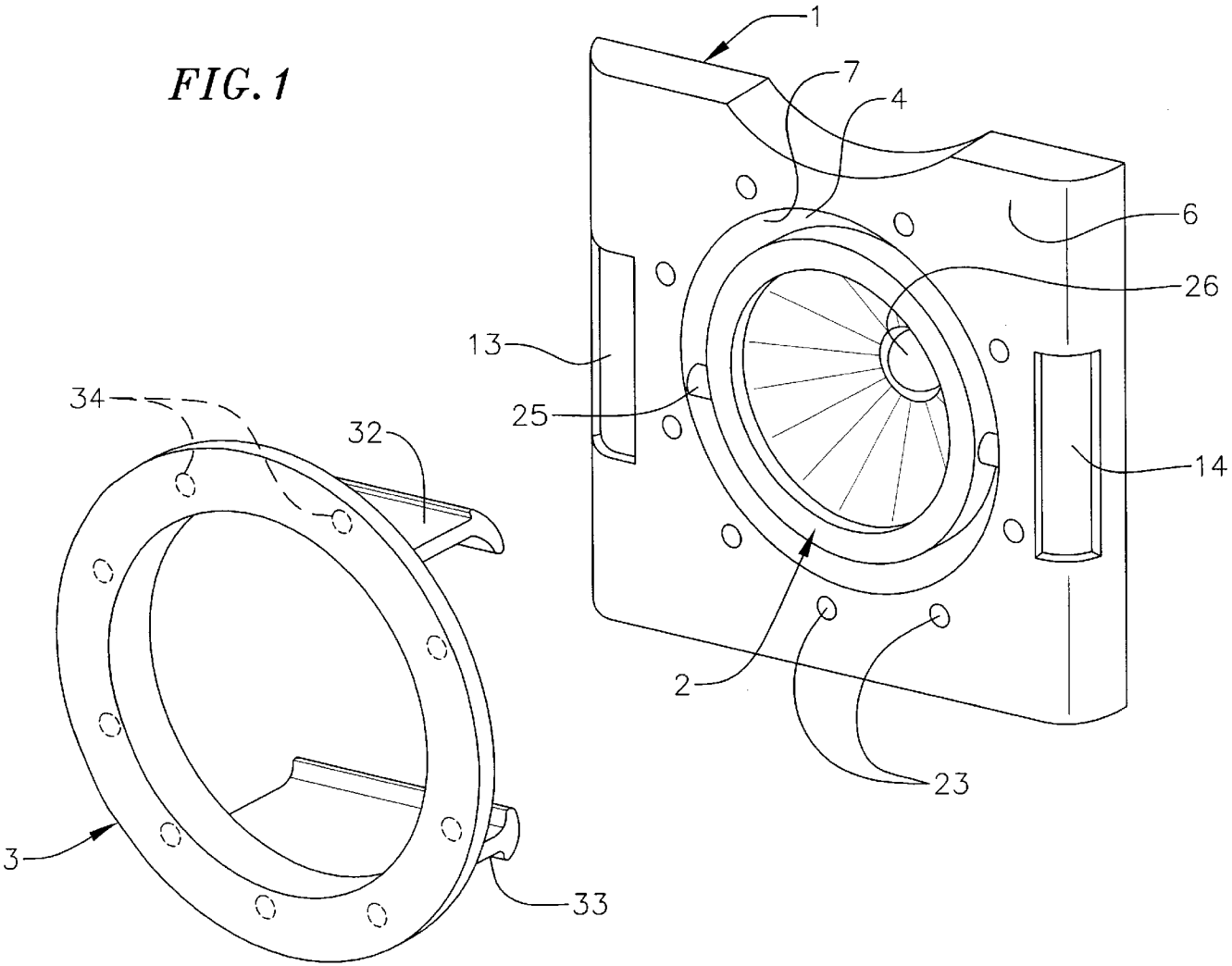
FIG. 1 is a schematic perspective drawing of the device of the invention.

The lighting device of the present invention mainly comprises three parts: a case (1), a lamp (2) and a ring (3), as shown in FIG. 1.

The case consists of a half-shell that is produced by being moulded in plastic. The overall shape is rectangular, approximately 6 cm wide, 7 cm long and 2.5 cm thick. The front surface (6) of the case includes a housing (7) intended to contain the lamp (2).

The depth of the housing (7) is greater than the thickness of the case given the thickness of the case (2.5 cm) compared to the length of the lamp (>2.5 cm).

Figure 3:
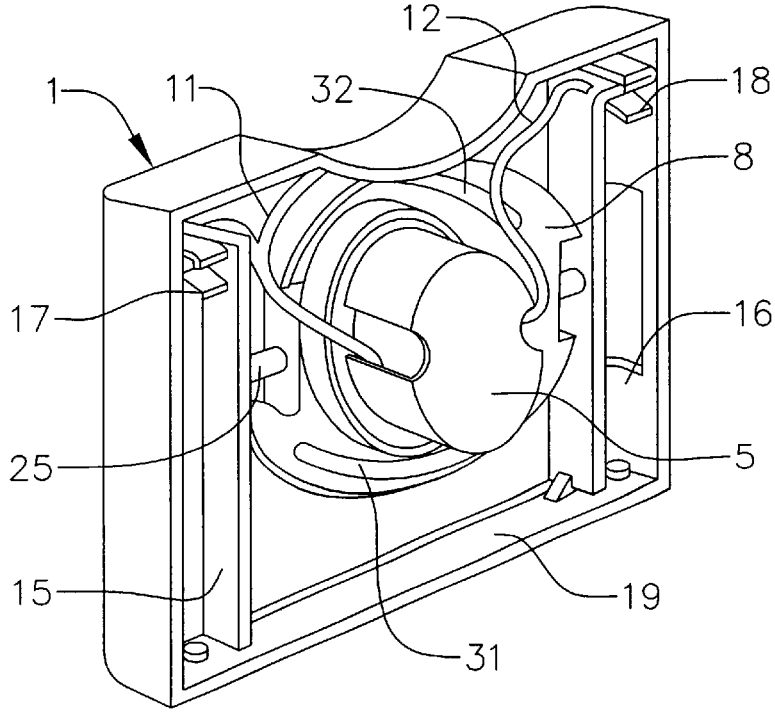
FIG. 3 is a schematic perspective drawing of the rear of FIG. 2.

In practice the housing (7) is in the shape of a circular window (4) cut into the thickness of the case and is extended from the inner surface of the case by a circular cavity (5) the diameter of which is smaller than that of the window (see FIG. 3). The cavity is either added or is included as part of the moulding with the case, the partition (8) that connects the window and cavity together having two slits (30, 31).

Figure 2:
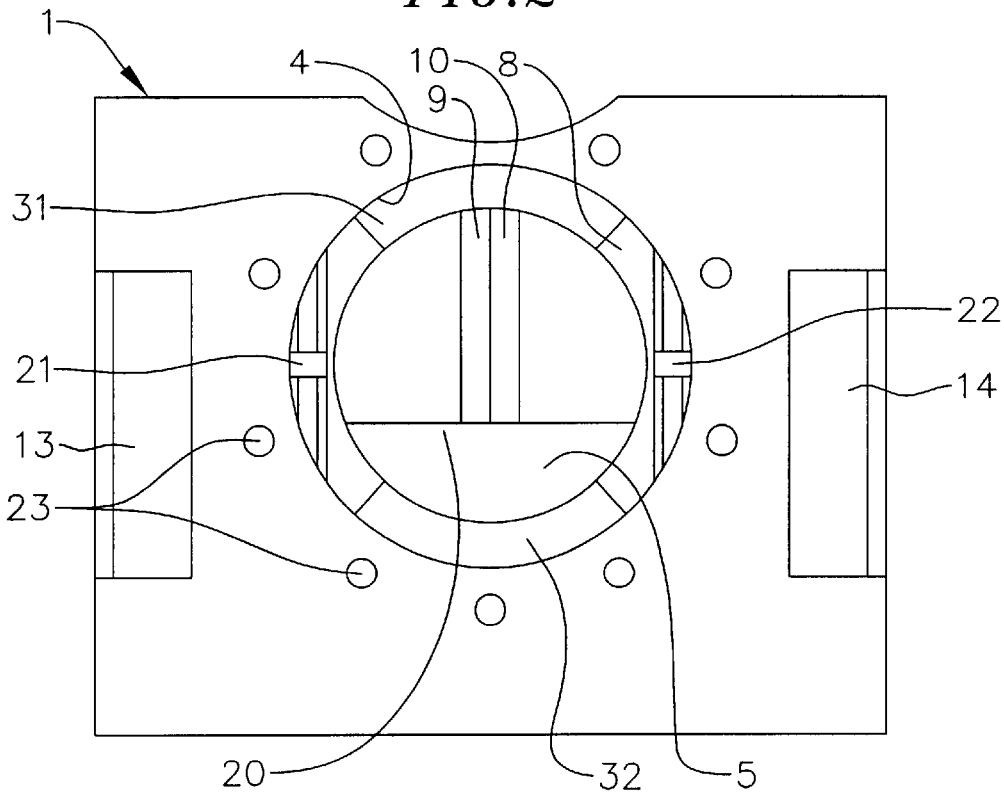
FIG. 2 is a schematic drawing of the front of the case.

As shown in FIG. 2, cavity (5) of housing (7) is provided with two blades (9, 10) that curve outwards from the case and that are intended to ensure the electrical contact with the positive and negative terminals of the lamp bulb. Each blade also has, on the one hand, a hollow used to cut the electrical contact with the bulb when the optical axis of the lamp is perpendicular to the plane of the case, and three pitches that match three directions of the lamp in a vertical plane, on the other. The blades are joined to the base of the cavity by any known means and are powered by means of wires (11, 12) that connect two batteries (13, 14) positioned in two compartments (15, 16) of the case (1) (see FIG. 3). More precisely, the batteries (13, 14) power the lamp (2) via two blade springs (17, 18) and a contact blade (19).

The cavity (5) also comprises a horizontal stop (20) that limits the travel of the lamp when it is tilted upwards. Similarly, the lateral surface of the housing (7) has recesses (21, 22) that house the pivoting pin of the lamp. The front surface (6) is also provided with a plurality of spikes (23) that project near and around the entire periphery of the housing (7).

Figures 4, 5:
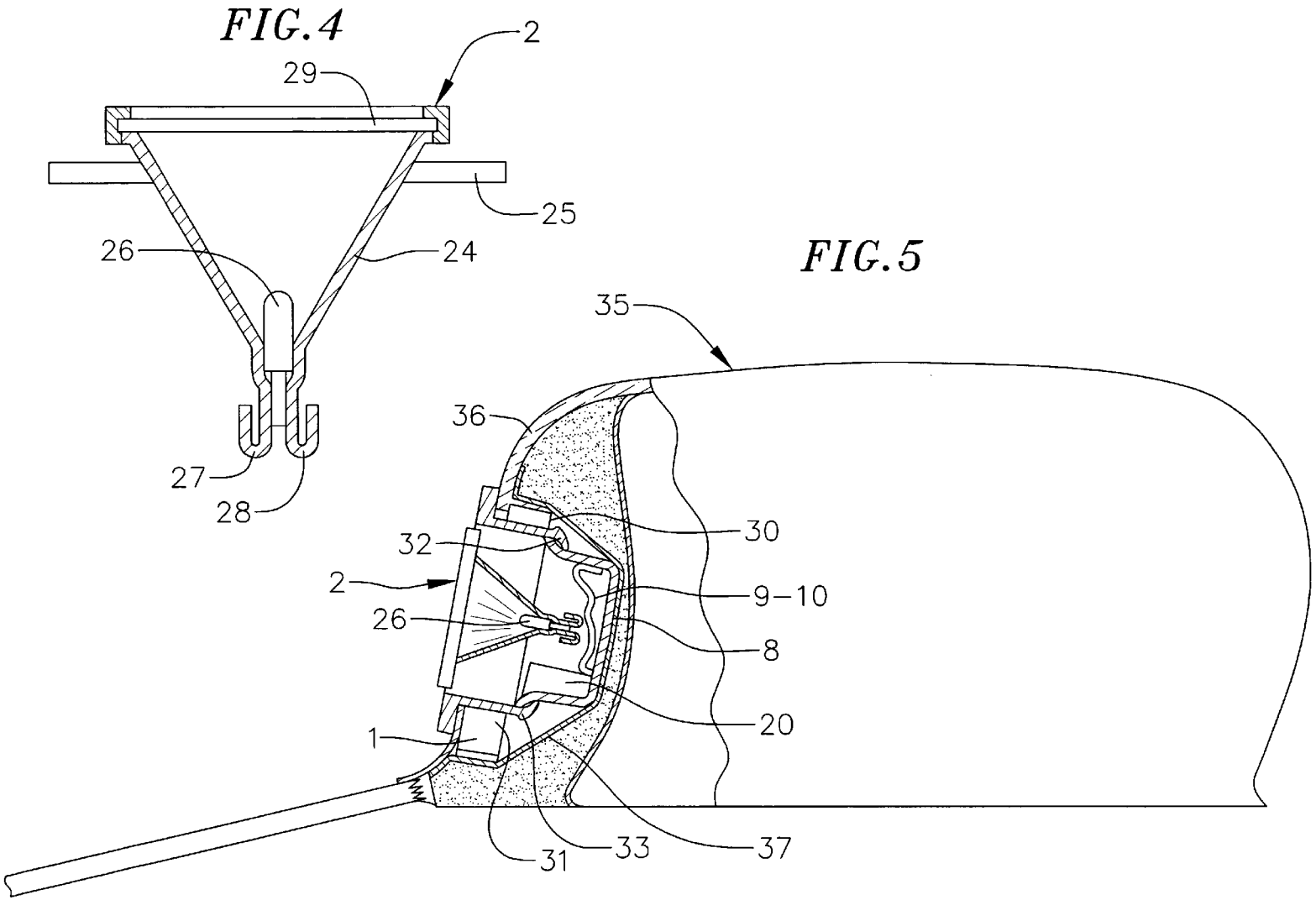
FIG. 4 is a profile view of the lamp.
FIG. 5 is a profile view of a cap fitted with the lighting device of the invention.

The lamp comprises a parabolic reflector (24) the inside surface of which is covered using a known technique with a reflective film, as shown in FIG. 4. According to one aspect of the invention the lamp is provided with a pin (25), which is horizontal in the example, the ends of which operate in conjunction with recesses (21, 22) in the lateral surface of window (4) of housing (7). The lamp is equipped with a pointed bulb (26) provided with stiff-core added terminals (27, 28) that hold the bulb in place in reflector (24). The lamp also comprises a removable protection glass (29) that may be more or less coloured depending on the user's requirements.

Each blade is also provided with three pitches for three different positions of the lamp in a vertical plane, as described above. The contact blades (9, 10) fitted in cavity (5) of housing (7) are curved such that the lamp is able to come into contact with said blades when it is pivoted relative to pin (25). The hollow in both blades is positioned such that the power supply is cut when the optical axis of the lamp is perpendicular to the plane of the case.

As shown in FIG. 1, the ring (3) is provided with two arms (32, 33) that operate in reverse conjunction with slits (30, 31) provided in partition (8) that connects window (4) to cavity (5) of the housing. The ring also comprises spikes (34) that prevent the lighting device from moving once the ring has been installed in the housing.

FIG. 5 shows the profile of a cap that bears, the general reference (35) and that is fitted with the lighting device of the invention. As this figure shows, the device is installed sufficiently high above the visor on the front (36) of the cap to enable a beam to be projected forwards.

In practical terms the front of the cap is cut such that it defines an opening the size of which is more or less equal to that of the housing or lamp. The case is then positioned against the inner surface of the front of the cap opposite the opening, the ring operating in conjunction with the housing to grip the material and thus fasten the lighting device (FIG. 5).

The user's skin is protected from the rear section of the case, and particularly the electrical connections, by a lining (37) that is reinforced with foam sewn onto the inner surface of the cap. In order to improve user comfort the cap is also provided with a padded seam located under the case, the thickness of the padded seam being greater than that of the case.

To light the bulb the user only has to tilt the lamp forward relative to its horizontal position, contact with the blades being achieved by sliding; The opposite procedure is performed in order to cut the power supply, stop (20) preventing the lamp from being tilted upwards beyond the horizontal position.

The invention and advantages may be seen clearly in the description.

It should be noted that the size of the invention is reduced to a minimum and that it is suited to any cap- or hat-type textile mounting and more generally to any clothing or stiff helmet- and similar-type mountings.

What is claimed is:

1. A lighting device for attachment to garment comprising:

said garment including an opening;

said lighting device including a case with a front surface and including a window, a plurality of spikes extending from said front surface and a housing projecting proximate the bounds of the window in a direction away from said front surface defining a cavity, said housing mounting an electrical contact, lateral recesses and at least one slit;

a power supply connected to said electrical contact;

a lamp including lateral pins received by said recesses for mounting the lamp to the housing for pivotal motion and terminals to engage the contact for powering said lamp, said terminals arranged to engage the contact and power said lamp in response to pivoting of the lamp; and a ring including an arm received in the slit to couple the ring to the case through said garment opening and trap said garment there between to attach the device to the garment with said lamp registering with said opening.

2. The device of claim 1 comprising said lamp includes a glass and said recesses and pins are disposed to locate said glass substantially co-planar with said front surface.

3. The device of claim 1 comprising said contact including a blade having a pitch to contact said terminals when said lamp is pivoted.

4. The device of claim 3 comprising said contact including a pair of blades having pitches.

5. The device of claim 1 comprising a circular ring.

6. The device of claim 1 comprising said ring including garment engaging spikes.

7. The device of claim 1 comprising said housing including at least two slits and said ring having an arm to be received by each slit.

8. The device of claim 1 comprising said case having a compartment to contain a battery power source.

9. A light and garment combination comprising:

said garment including and opening;

said light including a case with a front surface and including a window, a plurality of spikes extending from said front surface and a housing projecting proximate the bounds of the window in a direction away from said front surface defining a cavity, said housing mounting an electrical contact, a lateral recesses and at least one slit;

a power supply connected to said electrical contact;

a lamp including lateral pins received by said recesses for mounting the lamp to the housing for pivotal motion and terminals to engage the contact for powering said lamp, said terminals arranged to engage the contact and power said lamp in response to pivoting of the lamp; and a ring including an arm received in the slit to couple the ring to the case through said garment opening and trap said garment there between to attach the device to the garment with said lamp registering with said opening.

10. The combination of claim 9 comprising said garment is a hat.

11. The combination of claim 10 comprising said hat having a foam lining to retain said case.

12. The combination of claim 10 comprising said hat having a visor and said opening disposed above the visor.

13. The device of claim 9 comprising said lamp includes a glass and said recesses and pins are disposed to locate said glass substantially co-planar with said front surface.

14. The device of claim 9 comprising said contact including a blade having a pitch to contact said terminals when said lamp is pivoted.

15. The device of claim 14 comprising said contact including a pair of blades having pitches.

16. The device of claim 9 comprising a circular ring.

17. The device of claim 9 comprising said ring including garment engaging spikes.

18. The device of claim 9 comprising said housing including at least two slits and said ring having an arm to be received by each slit.

19. The device of claim 9 comprising said case having a compartment to contain a battery power source.

* * * * *